US005553330A

United States Patent [19]

Carveth

[11] Patent Number: 5,553,330

[45] Date of Patent: Sep. 10, 1996

[54] PROTECTIVE HOCKEY HELMET

[76] Inventor: William H. Carveth, 8118 Rowland Rd., Edmonton, Alberta, Canada, T6A 3W8

[21] Appl. No.: 207,135

[22] Filed: Mar. 7, 1994

[30] Foreign Application Priority Data

Feb. 18, 1993 [CA] Canada ..... 2091936

[51] Int. Cl.[6] ..... A42B 3/00

[52] U.S. Cl. ..... 2/425; 2/414; 2/424

[58] Field of Search ..... 2/410, 411, 414, 2/415, 416, 421, 422, 424, 425, 9, 2

[56] References Cited

U.S. PATENT DOCUMENTS

| | | | |
|---|---|---|---|
| 1,163,247 | 12/1915 | McGrew | 2/424 |
| 1,244,559 | 10/1917 | Stocks | 2/424 |
| 3,242,500 | 3/1966 | Derr | 2/425 |
| 3,991,421 | 11/1976 | Stratten | 2/2 |
| 4,477,929 | 10/1984 | Mattsson | 2/425 |
| 4,825,476 | 5/1989 | Andrews | 2/425 |
| 5,295,271 | 3/1994 | Butterfield et al. | 2/424 |
| 5,353,437 | 10/1994 | Field et al. | 2/425 |
| 5,444,870 | 8/1995 | Pinsen | 2/2 |

FOREIGN PATENT DOCUMENTS

| | | | |
|---|---|---|---|
| 2039185 | 9/1992 | Canada . | |
| 108694 | 5/1984 | European Pat. Off. | 2/411 |
| 2240255 | 7/1991 | United Kingdom | 2/421 |

*Primary Examiner*—Michael A. Neas
*Attorney, Agent, or Firm*—Bauer & Schaffer

[57] ABSTRACT

A helmet that prevents catastrophic neck injuries; in the preferred embodiment, for hockey, a high-impact plastic casing is snugged on top of the player's head by cantilever supports from the inside sides of the casing; a flange at the bottom of the casing is formed so that a collision such as a head-on collision on top of the head will drive the helmet into contact with the torso, thus transmitting all collision force to the torso. The top of the helmet is high enough that the top of the head does not contact the underside of the top of the helmet under the peak collision force. Further, in the most dangerous high-incident-angle collisions, a tip projecting rearwards from the top of the helmet, in conjunction with rollers on the top surface, act to position the helmet for symmetrical transmission of force axially. A second embodiment, without the tip and rollers, is also described, as is a third with a rear extension segment to prevent the flange from contacting the back of the neck in cases of rearwards flexure of the neck.

12 Claims, 7 Drawing Sheets

PROTECTIVE HOCKEY HELMET

INTRODUCTION AND DESCRIPTION OF THE PRIOR ART

Paralyzing spinal chord injuries occurring in sports from the neck being bent too far forward when it is subjected to an excessive axial load (according to accepted understanding) are a serious problem; particularly in hockey. The present invention proposes a new type of protective helmet that is based on an understanding of the engineering mechanics of catastrophic damage to the neck.

Careful and thorough analysis of this problem is necessary because of the immensity of the personal tragedy and of the enormous financial cost involved; persons paralyzed in such injuries frequently suffer afterwards from interminable medical problems. And equipment manufacturers frequently face substantial court defence costs.

As will be made more clear in the disclosure to follow, the neck injuries addressed can be understood from an engineering stand-point to occur in two very different modes: the first, by far the most serious, is critical load buckling; the second is moderate non-elastic deformation. In the first the neck bends laterally rearward in an elastic manner, and then buckles abruptly, concentrating the energy, and damage, to a limited region and usually causing permanent spinal cord damage; in the second, the whole neck bends relatively smoothly, each intervertebral disk bending a moderate amount; there is often stretch damage but nothing catastrophic. The present invention principally addresses the first of these problems, which is all-too-often the cause of death and paralysis.

It is already understood medically that such catastrophic injuries occur from excessive axial load on the neck when it is bent forward. A prime example of this is the top of the head of a hockey player hitting the boards of a hockey arena at high speed, when the neck is slightly bent and the head is below the shoulders. Current helmets do little or nothing to lessen the damage: almost the whole force is transmitted through the helmet to the skull and hence to the neck vertebrae.

In the prior patent art there have been several attempts to solve similar or related problems in other sports, although nothing for hockey and nothing that uses the method that will be outlined. U.S. Pat. No. 5,123,408, Gaines, shows a football helmet specifically designed to prevent whiplash of the head forward and backwards; axial load is not addressed. U.S. Pat. No. 3,879,761 shows a huge and unwieldy apparatus that encloses the head completely as well as covering the shoulders, chest, and back; it is designed for motorcyclists and would be useless for a sport that requires high-speed agility combined with good peripheral vision. Similarly Canadian patent #2,039,185 shows a combination helmet and upper body protector that is so large as to be unlikely to be worn in any sport, and is designed to protect the "head, skull, face, chin, back, chest and shoulders". Finally, U.S. Pat. No. 3,242,500, Derr, shows a football helmet with cushioning and shoulder collar, and is superficially similar to the present invention in that the collar extends down towards the shoulders, but axial load is not addressed. The purpose of Derr is to prevent quick rotation of the head caused when someone grabs the football-player's face-guard, and the collar is placed for this purpose. In fact, axial load on the neck would be exacerbated in Derr because of the cushioning inside the helmet, which transports force from the outside of the helmet to the skull. In sum, the present invention appears to be a novel way to deal with a very serious and persistent sports problem.

The present invented helmet, which may find use in many sports including football, cycling, ski racing, and auto and motorcycle racing, has a rounded top extending well above the top of the head. Force on the top shoves the helmet down so that the bottom edge, which can have a flange to enlarge the contact area, transmits the collision force to the torso; the top of the head does not contact the top of the helmet, which is high enough so that there is an air space between it and the head-top even when a strong force drives the helmet into the torso. In this way axial load onto the neck vertebrae is minimized, even to zero; even in a serious collision.

In the preferred embodiment, for hockey, the rounded top of the helmet extends well back of the head to a tip, and there are rollers along the top surface of the helmet. As will be described and diagrammed fully below, the tip and rollers act to position the helmet during a near head-on collision so that the bottom flange settles symmetrically on the torso and the collision force is transmitted fully to the body, avoiding the neck. Cantilever supports from the inner surface of the helmet, extending above the head with support pads, hold the helmet in position during play, and are easily flexed to the sides, out of the way, during a collision. Energy absorbing liners inside the front and back of the helmet help hold the helmet in position during play and can be helpful cushions during more minor side collisions or knocks. Note that there is no such liner inside the top of the helmet, since it is not useful to have any force imparted to the head during the more serious axial collisions.

Note also that serious injury, including death by internal hemorrhaging, from blows high to the side of the neck such as with a hockey puck will be effectively prevented as well with this device, which will be constructed of a high-impact plastic sufficient to withstand a collision force which could be in the magnitude of 4,000 pounds (from a 20-g collision of a 200 pound player) directed axially to the neck; pucks hitting the side of such a helmet will be easily deflected. The plastic will likely be transparent, as is shown in the diagrams to follow, to offset the visual distraction to the audience of the increased size of this helmet.

An object of the invention is to provide a helmet for prevention of collision-induced injuries, including severe neck injuries, comprising a casing formed to fit overtop a human head and extending downwards to the torso, and an energy-absorbing liner inside the casing. During regular use, that is, not during a collision, the helmet is positioned on the head by the liner; and the casing is shaped appropriately, and is strong enough, so that a strong force on the top of the casing, causing the helmet to shift downwards and press into the torso, will not cause the helmet or liner to press on the top of the head. This casing could be formed to be stiffer above the back of the head and above the front of the head than above the center of the head so that under the influence of the strong force, produced when the top of the helmet contacts a plane surface, the helmet will stabilize rather than roll, and press symmetrically into the torso. The bottom of the casing could have a flange so as to distribute the force onto the torso over a larger surface area; the casing could extend downwards to just above, but not touching, the torso supporting the head; and there could be means of supporting the casing on top of the head and of positioning the helmet on the head along with the liner during regular use. This support means could consist of flexible cantilever supports affixed to the inside of the casing.

It is also an object to provide for a helmet for prevention of injuries, including severe neck injuries, during the game of ice-hockey, comprising: (a) a high-impact plastic casing formed to fit overtop, and loosely follow the contours of a human head, excepting that a gap is left at the face of the head; and additionally comprising: an outwardly flaring flange at the bottom conforming to the surface of the human torso surrounding and just below the neck; an upwards extension rising substantially above the top of the head; a tip at the rearwards extent of the extension, the tip rising farther from the head than the portion of the extension above the front of the top of the head; and stiffening ridges moulded integrally in the casing so that the casing is stiffer under the tip and above the front of the head than above the middle of the top of the head; (b) rollers on the top of the extension, the rollers having axis of rotation parallel to a line between the centers of the ears of the head; that is, substantially horizontal when the head is upright; (c) a front energy-absorbing liner, affixed inside the casing and contacting the forehead and temples of the head; (d) a rear energy-absorbing liner, similarly affixed and contacting the rear of the head at approximately ear-level; (c) flexible cantilever supports affixed inside the casing and extending outwardly overtop the head; (f) cantilever pads fixed below the ends of the cantilever supports and having a lower surface appropriate to contact the top of the head; (g) a face-guard affixed to the casing and extending in front of the face of the head; and (h) a chin cup affixed to the inside of the face-guard, to snugly hold the chin of the head; so that during regular play, that is, not during a collision, the helmet is supported on the head by the cantilever supports, cantilever pads, and front and rear energy-absorbing liners, and the casing extends downwards to just above, but does not touch, the torso; and further so that the casing is strong enough so that an approximately 4,000 pound force on the top of the extension, such as sustained by a player wearing the helmet skating head-first into hockey boards, causing the helmet to shift downwards and press the flange against the torso, will not press the helmet against the top of the head of the player.

A hockey player may make use of this helmet to prevent injuries, in at least the two following ways: the first being during regular play in which there are knocks and hits to the outside of the helmet such as pucks, sticks, or gloves, and in which the strength of the casing, in combination with the chin cup, face-guard, cantilever pads, cantilever supports, front energy-absorbing liner, and rear energy-absorbing liner will substantially reduce or eliminate any injury from such knocks and hits, including pucks striking at neck level; and the second being during a head-first collision between the player and a wall such as hockey arena boards, in which the player is commonly face-down and approaches the wall with axis of the cervical spine parallel to the ice or tilted front-down somewhat, so that the outermost portion of the extension strikes the wall with the tip being vertically higher than the axis of rotation of the helmet about the head, so that the momentum of the head and torso causes pressure against the cantilever pads and therethrough to the cantilevers and so to the casing, causing the helmet to begin to rotate in a direction that takes the tip vertically upwards, following which the rollers facilitate the movement of the helmet upwards along the surface of the wall, the helmet rotates until the bottom rear surface contacts the neck: the head, neck, and part of the top of the torso move forward inside the helmet pushing the flexible cantilevers to the side: the flange settles against and symmetrically around the torso, stabilized against the stiffer portions of the casing under the tip and above the front of the head: and essentially the full reaction force from the wall is transmitted through the helmet casing, including through its integral stiffening ridges, to the torso, thereby preventing axial load on, and injury in, the neck of the player.

Such a helmet could have the casing formed so that the distance from the point of rotation of the casing about the head to the outer surface of the casing increases progressively and substantially from the front of the head to the tip.

It is also an object to provide for cases for the helmet just described wherein the upwards extension has no tip or rollers and is rounded to approximately follow the contour of the human head; and wherein during the described collision in which the axis of the cervical spine is parallel to the ground or tilted front-down somewhat the helmet does not move upwards along the boards, due to the lack of tip or rollers; and wherein the support means reacts with a designed minimal force against the head; and wherein a substantial portion of the strong force of the collision is transmitted to the top of the torso by means of the casing and flange, thereby precluding any possibility of the cervical spine being subjected to a force great enough to cause critical load buckling, so that what injury does occur is limited to relatively uniform bending of the neck causing moderate damage to connective tissues.

In the helmet just described or the one penultimately described, the portion of the casing over the back of the neck could have an extension or a flexible segment that extends down past the neck to the top of the torso, so that backwards flexure of the neck will not press a bottom edge of the casing into the back of the neck.

DETAILED DESCRIPTION OF THE INVENTION

Figure 1:
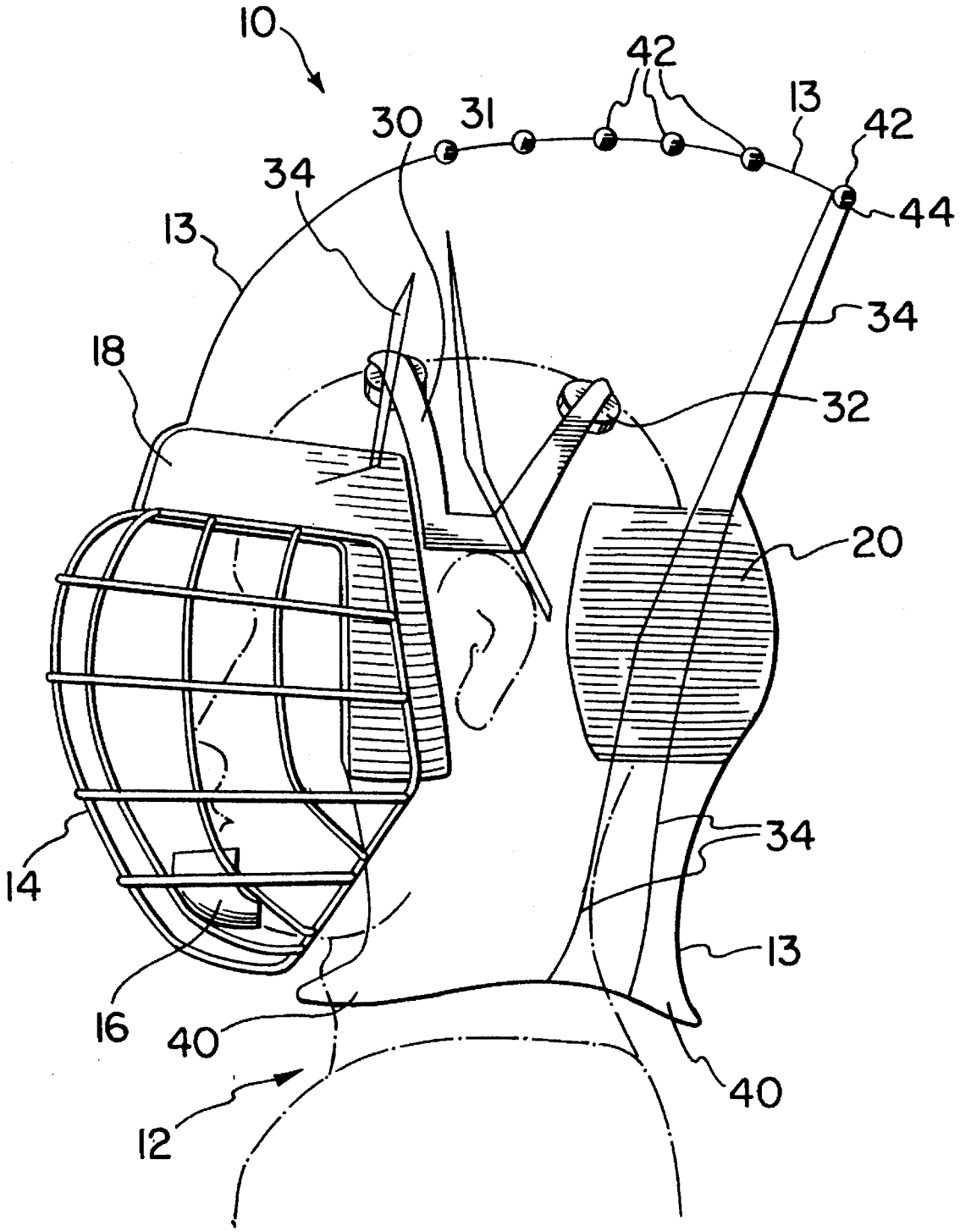
Figure 2:
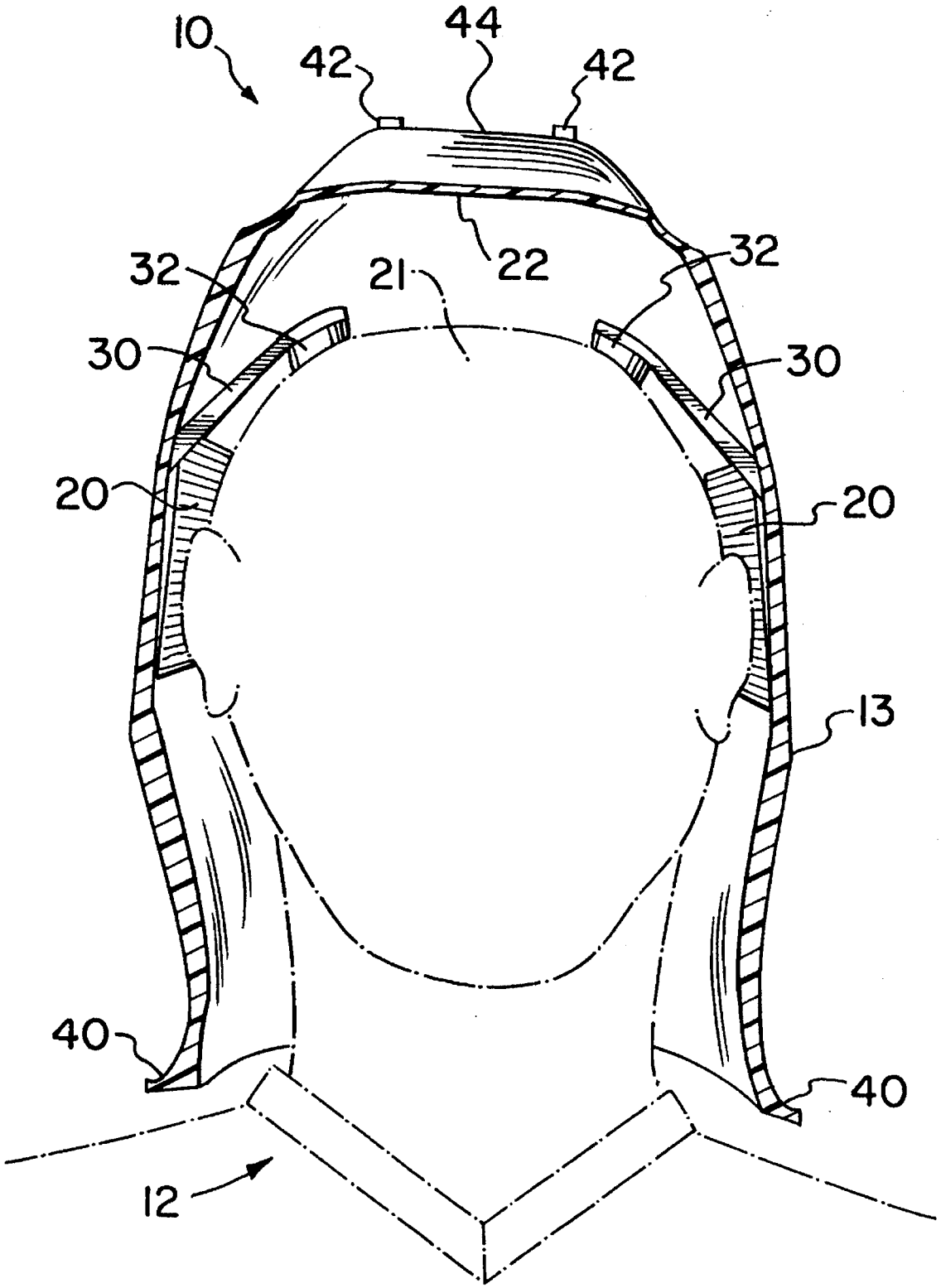
Figure 3:
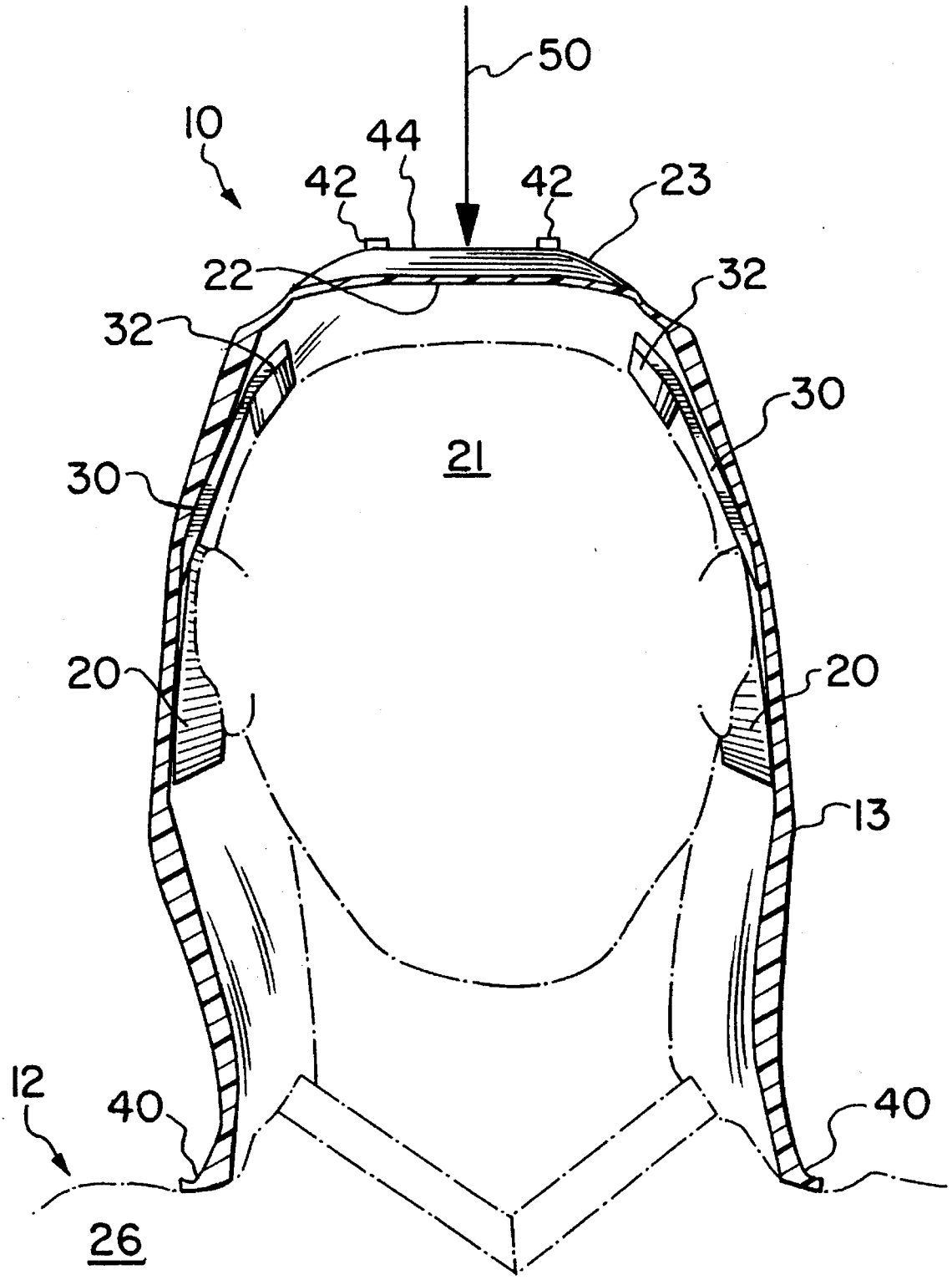
Figure 4:
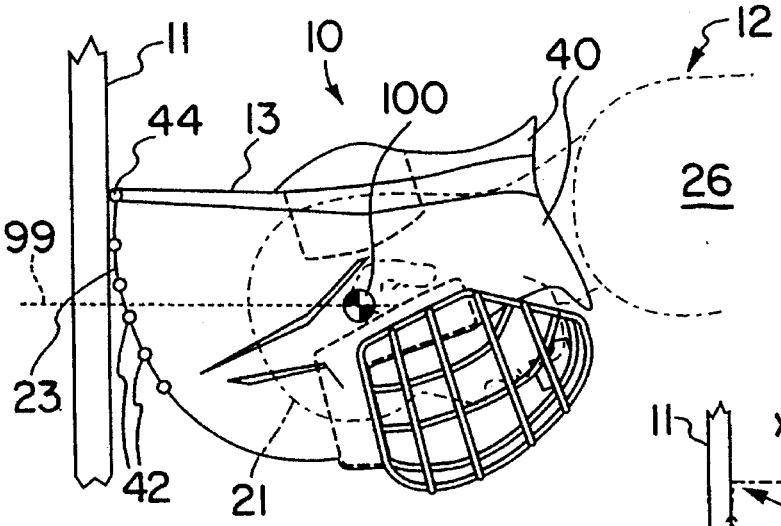
Figure 4B:
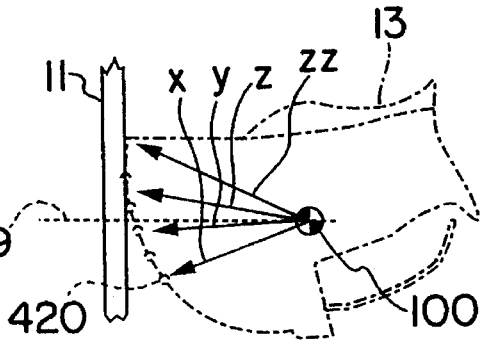
Figure 5:
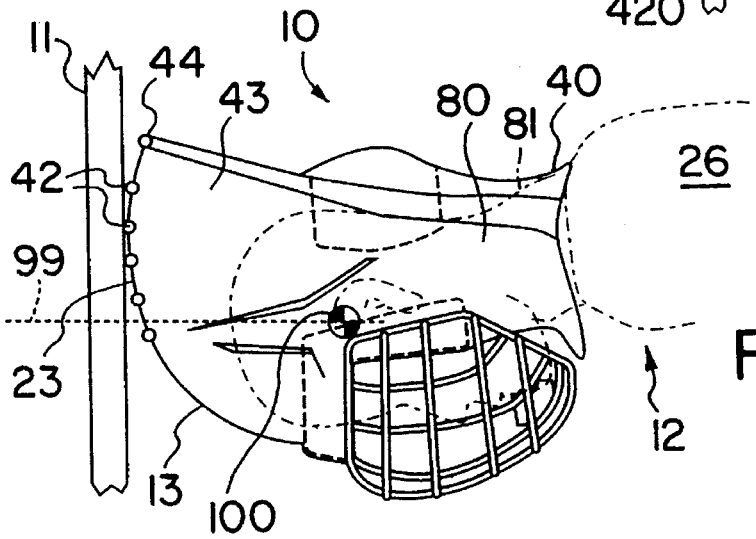
Figure 6:
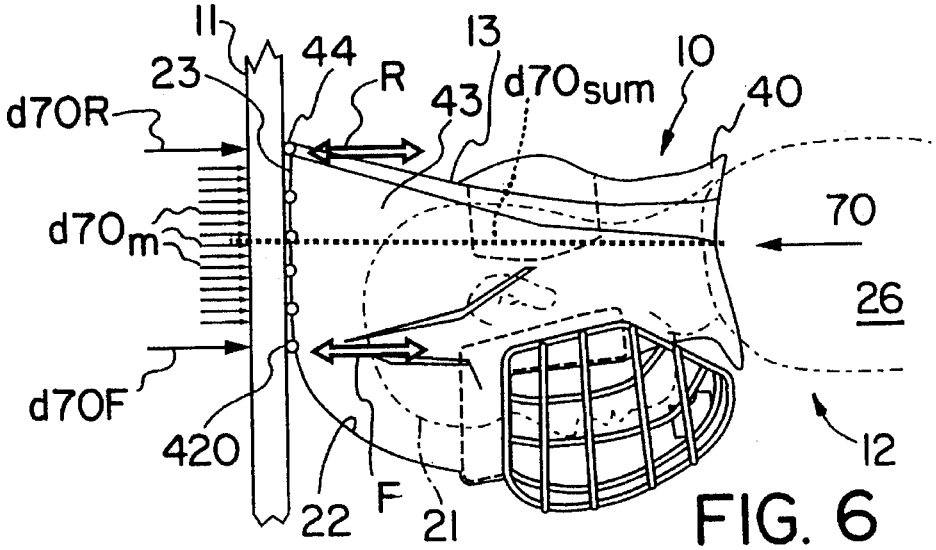
Figure 7:
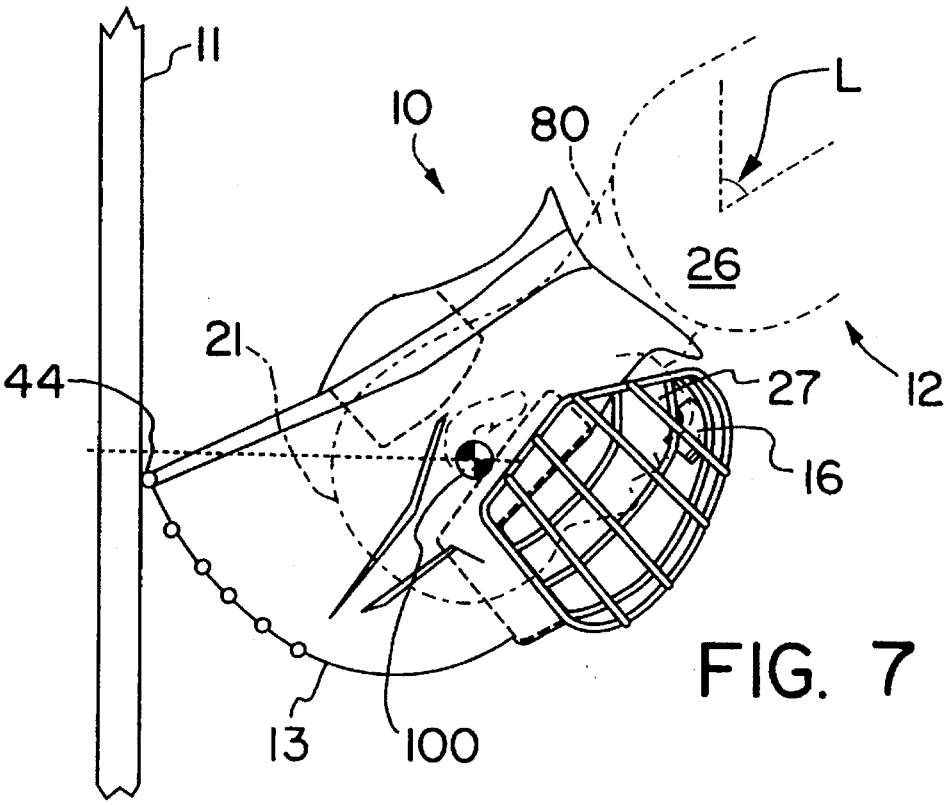
Figure 8:
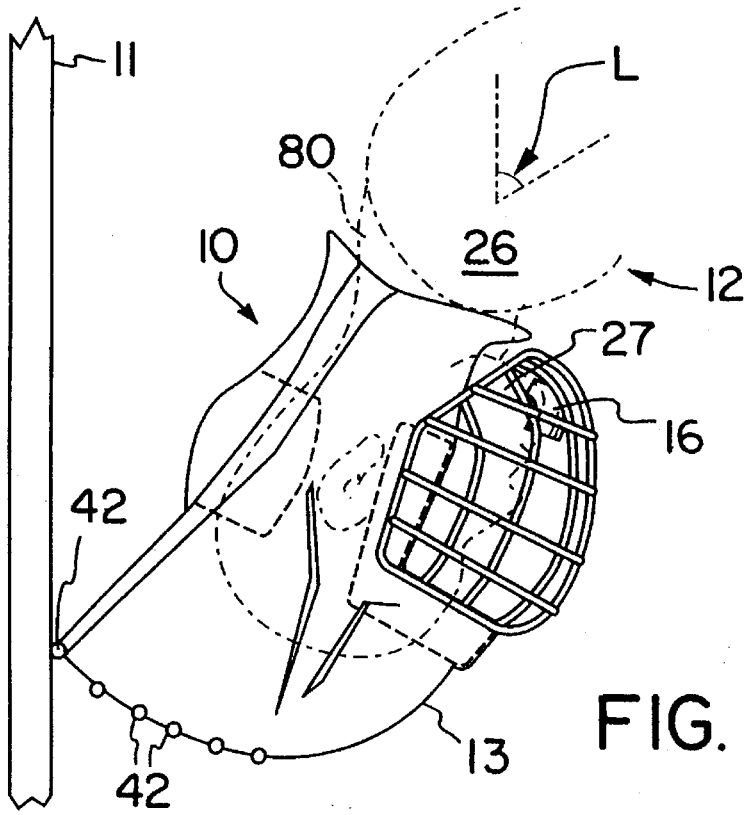
Figure 9:
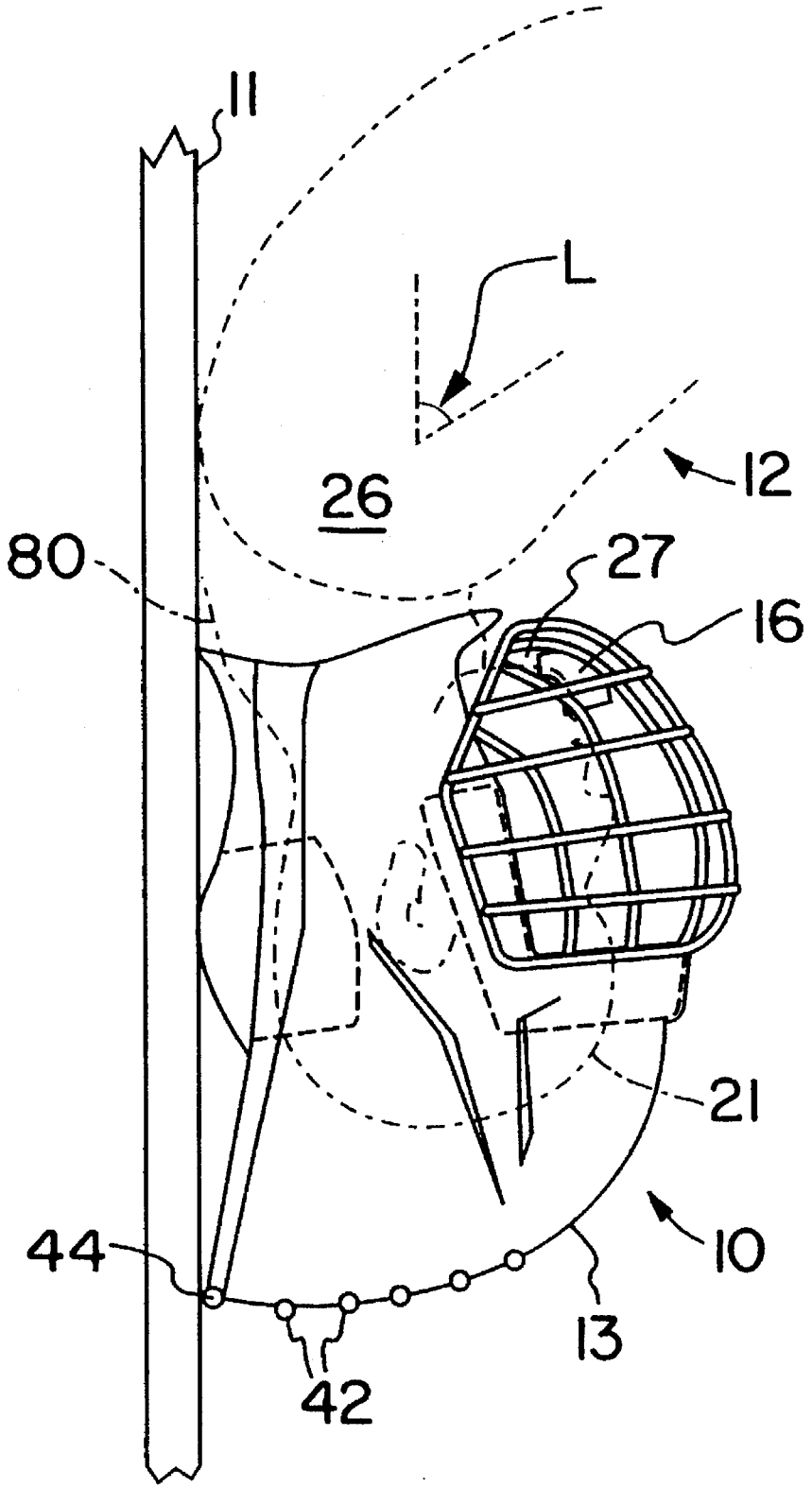

For this description, refer to the following diagrams, wherein like numerals refer to like parts:

FIG. 1, preferred embodiment of the invented helmet in play position, showing user's head and torso in ghost line, side elevation;

FIG. 2, the helmet and ghosted user of FIG. 1, front elevation section;

FIG. 3, as in FIG. 2, except in peak-collision position;

FIG. 4, the moment of first impact of the preferred embodiment of the invented helmet in near-horizontal (high angle of incidence) collision; side elevation;

FIG. 4B, schematic of the helmet of FIG. 4; side elevation;

FIG. 5, as in FIG. 4, but one moment later with helmet shifted by rollers; side elevation;

FIG. 6, as in FIG. 5, one moment later; helmet accepting peak force of collision and transmitting it to torso of user; side elevation;

FIG. 7, the moment of first impact of the preferred embodiment of the invented helmet in oblique (low angle of incidence) collision; side elevation;

FIG. 8, as in FIG. 7, but one moment later with helmet and player's head and neck shifted by collision; side elevation;

FIG. 9, as in FIG. 8, one moment later, with neck of player showing curvature resulting from collision; side elevation; and FIGS. 10 through 13, second embodiment of the invented helmet with no tip or rollers, collision sequence showing neck of player showing curvature resulting from collision; side elevation.

In FIG. 1 an example of the preferred embodiment of the helmet is generally indicated at 10; user 12 is indicated in ghost lines. In this view can be seen (here transparent) casing 13, and attached face guard 14, chin cup 16, front energy-absorbing liner 18, rear energy-absorbing liner 20, cantilever supports 30, cantilever pads 32, stiffening ridges 34, casing flange 40, rollers 42, and casing edge 44. The arrangement of helmet 10 about ghost player 12 may be better appreciated by looking at FIG. 2; as shown by the section lines, casing 13 is preferably of a plastic, and transparent, although any material that satisfies the strength needs of approximately a 20-g axial load collision, as high-impact plastic is calculated to do in this configuration, will be acceptable as long as it, like plastic, is also light enough to allow the user to play hockey effectively. Note that between the head 21 of user 12 and the inner top surface 22 of casing 13 there is only air space (save for cantilever supports 30 and pads 32).

We see the reason for this clearly in FIG. 3, where an unspecified force acting in direction of arrow 50 has moved helmet 10 relative to player 12 so that flange 40 contacts torso 26, and, as shown, presses in on it. This FIG. 3 shows the envisioned maximum extent due to such a force during a very strong collision; and although head 21 is closer to surface 22, it is still safely not in contact with surface 22. Thus the entire force represented by arrow 50 is born through casing 13 onto torso 26. Stiffening ridges 34, best seen on FIG. 1, aid casing 13 in transmitting force 50. Cantilever supports 30 and cantilever pads 32 are simply pushed up and to the side as shown in FIG. 3.

Two distinct common hockey collision situations will now be discussed for this preferred embodiment.

In the first, illustrated in FIGS. 4, 5, and 6, which are in sequence of time, user 12 wearing helmet 10 is colliding with hockey boards 11; in FIG. 4 edge 44 of casing 13 has just contacted boards 11. Edge 44 is above symbol 100, which represents the point about which the helmet rotates about the head. (The dotted line 99 indicates horizontal level through rotation point 100). As can be seen clearly on outline FIG. 4B, the profile of casing 13 has been expressly designed so that the distance from rotation point 100 to edge 44 is greater than to frontmost roller 42; in other words, the distances represented by arrows x, y, z, and zz are gradually increasing. Thus, in FIG. 4, as a consequence of this profile, the point of contact between outer surface 23 of casing 13 and boards 11 is above horizontal level 99; and thus the momentum of user 12 acting on the cantilever supports 30 (which can be assumed but are not shown on FIGS. 4 through 13 to afford a clearer view of the movement of head 21) causes helmet 10 to begin rotating clockwise. The result of this is seen in FIG. 5, where helmet 10, facilitated by rollers 42 rolling along boards 11, has rotated until flange 40 is contacting back 81 of neck 80. Now flange 40 is properly located for peak collision reaction force, represented by sum of arrows d70m, d70R, and d70F in FIG. 6, to be transmitted to torso 26; simultaneously, the edge 44 of the rear projection 43 is at its most rearward position. As shown in FIG. 6, this occurs as casing 13 is deformed so that rollers 42 are pushed inwards, and casing 13 accepts force along the entire outer surface 23 touching boards 11. Here stiffening features 34, along with general design of helmet casing 13, come into play in a critical manner: casing 13 is very much stiffer in the region of rear support, indicated at arrow R, and in the region of fore support, indicated at arrow F, than in the area between. Thus when the torso 26 reacts against the flange 40, the casing 13 between regions R and F deflects until it is flattened against the boarding 11 , thereby generating a constant reaction d70m; reactions d70R and d70F are then generated, these two forces increasing in magnitude as the collision progresses, the sum of these three reactions (d70m, d70F, and d70R) equalling the collision force indicated by arrow 70. These same three reaction forces will average at a horizontal level indicated by dotted line $d70_{sum}$; since this line $d70_{sum}$ is necessarily between regions R and F, the helmet stabilizes instead of rolling. Meanwhile at torso 26, still referring to FIG. 6, force 70 is transmitted evenly from casing 13. Note that top of head 21, though closer to inner surface 22 of casing 13, is in no danger of contacting surface 22.

A second common hockey collision situation is illustrated in FIGS. 7, 8 and 9, which is identical to the first excepting only that, as seen in FIG. 7, edge 44 is now below point 100: in other words, player 12 is striking boards 11 at a relatively low angle of incidence, represented by angle 1, on FIG. 7, and helmet 10 begins rotating in a counter-clockwise direction about head 21, causing chin-cup 16 to push against chin 27 and thereby causing the flexure of neck 80 seen in FIG. 8. As the collision proceeds, as shown by FIG. 9, rotation of the helmet 10 has proceeded by virtue of the momentum of the head 21 and torso 26 until flange 40 contacts boards 11; neck 80 is further flexed.

Although the possibility of injury to player 12's neck 80 in this second scenario is present, it is important to clarify that any injury so sustained is almost certain to be moderate non-elastic deformation; in other words, relatively evenly-curved bending. Due to the low angle of incidence 1, neck 80 will curve a maximum of about 45 degrees (as illustrated at 1), or about an average of 6.5 degrees for each of the seven connections in the cervical spine (the connection of C2 to the skull, 5 discs between C2 and C7, and the disc between C7 and T1). This is contrasted with what can be demonstrated in the case of critical buckling, which shows angles in the neighbourhood of 110 degrees between just two vertebrae. (These critical buckling angles and disks are not shown here diagrammatically).

Figure 10:
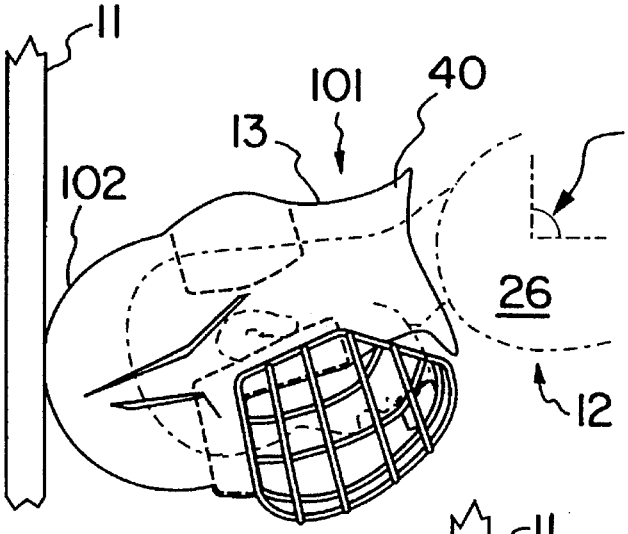
Figure 11:
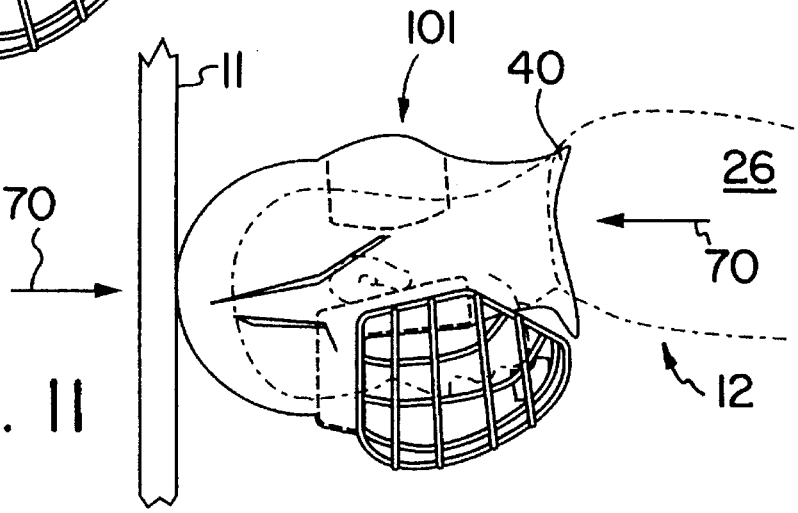
Figure 12:
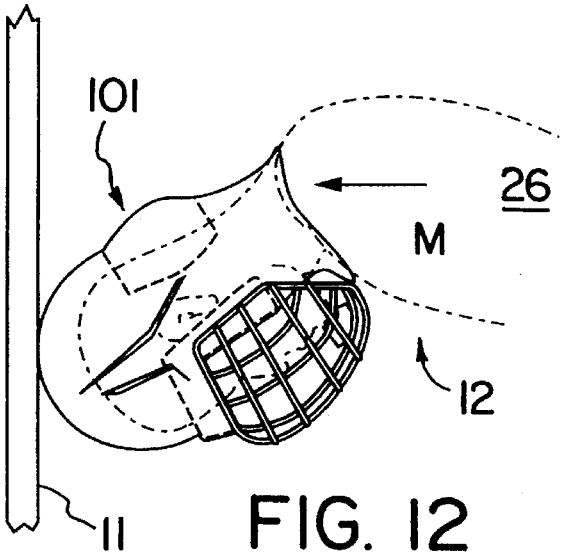
Figure 13:
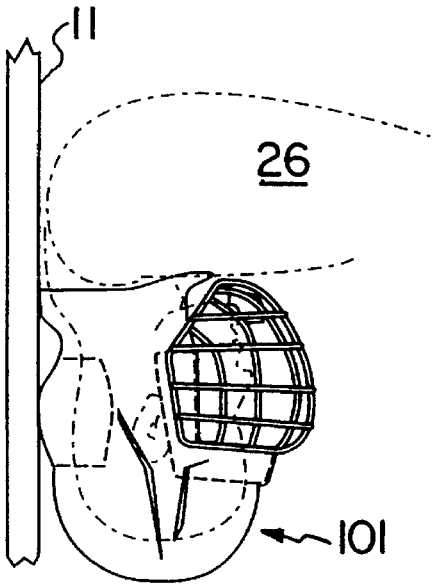

Finally, a second embodiment is possible without the tip and rollers; in FIGS. 10 through 13 a similar collision is illustrated in a time-sequence. In FIG. 10 rounded helmet indicated as 101 has rounded top surface 102 just contacting boards 11. (Again, cantilever supports 30 and cantilever pads 32 are assumed but not shown to afford clear view of movement of head 21). This is a high angle of incidence collision, indicated as angle H. Proceeding to FIG. 11, it can be seen that a significant portion of the reaction force indicated by arrow 70 will be transmitted to torso 26 through flange 40, and this will protect the cervical spine (not indicated) from excessive axial load and therefore from critical load buckling of the neck vertebrae. Although this is a major advantage of this embodiment over prior art, it is foreseen, as can be seen by referring to FIGS. 12 and 13 as the collision proceeds, that without the tip and rollers of the preferred embodiment, the momentum (acting in direction of arrow M on FIG. 12) of torso 26 will carry torso 26 to boards 11 to a position similar to that in FIG. 13. Although still presumably in the realm of "moderate" non-elastic deformation, injuries in this scenario are likely to be more serious than those corresponding to the similar position in FIG. 9, due to the higher angle of incidence H and thus larger flex for each cervical vertebra (vertebrae are not shown).

A third embodiment is envisioned (not diagrammed here) in which the downward extension of the rear of the helmet would extend a bit below the top of the torso. In the event of a collision bending the neck backward enough to cause serious injury (which is rare in hockey, in any event), the extended rear of the helmet would not permit the helmet to touch the back of the neck, where it might conceivably do some damage in worst-case scenarios. This extension could pivot at the base of the helmet, or it could be flexible by means of segments. Field testing the preferred embodiments will determine whether this additional embodiment is necessary.

It might be noted in closing that to maximize rigidity and strength and to minimize weight, the helmet shell would be a single molded piece. This would of course eliminate adjustment fasteners that invariably work loose and fall out. Individual fit could be achieved by placing spacers between the shell and the energy-absorbing liners (these are not diagrammed). Only two circumstances are envisioned in which the helmet might fail to protect the cervical spine; a collision force exceeding the design limit: or breakage due to degradation of the plastic shell, which is an inevitable problem with any plastic. A date could be molded into the helmet indicating when it should be taken out of service and destroyed. Breakage at a low temperature would not be a problem with a shell molded from a high strength polycarbonate.

The embodiments of the invention in which an exclusive property or privilege is claimed are defined as follows:

1. A helmet for prevention of injuries, including severe neck injuries, during the game of ice-hockey, comprising:

(a) a high-impact plastic casing formed to fit overtop, and loosely follow the contours of, a human head, excepting that a gap is left at the face of the head; and additionally comprising:

an outwardly flaring flange at the bottom conforming generally to the surface of the human torso surrounding and just below the neck;

an upwards extension rising substantially above the top of the head;

a tip at the rearwards extent of the extension, said tip rising farther from the head than the portion of the extension above the front of the top of the head; and stiffening ridges moulded integrally in the casing so that the casing is stiffer under the tip and above the front of the head than above the middle of the top of the head;

(b) rollers on the top of the extension, the rollers having axis of rotation parallel to a line between the centers of the ears of the head; that is, substantially horizontal when the head is upright;

(c) a front energy-absorbing liner, affixed inside the casing and contacting the forehead and temples of the head;

(d) a rear energy-absorbing liner, similarly affixed and contacting the rear of the head at approximately ear-level;

(e) flexible cantilever supports affixed inside the casing and extending outwardly overtop the head;

(f) cantilever pads affixed below the ends of the cantilever supports and having a lower surface appropriate to contact the top of the head;

(g) a face-guard affixed to the casing and extending in front of the face of the head; and (h) a chin cup affixed to the inside of the face-guard, to snugly hold the chin of the head;

wherein during regular play, that is, not during a collision, the helmet is supported on the head by the cantilever supports, cantilever pads, and front and rear energy-absorbing liners, and the casing extends downwards to just above, but does not touch, the torso;

and wherein the casing is strong enough so that an approximately 4,000 pound force on the top of the extension, such as sustained by a player wearing the helmet skating head-first into hockey boards, causing the helmet to shift downwards and press the flange against the torso, will not press the helmet against the top of the head of the player;

and whereby a hockey player may make use of the helmet to prevent injuries, in at least the two following ways, the first being during regular play in which there are knocks and hits to the outside of the helmet such as pucks, sticks, or gloves, and in which the strength of the casing, in combination with the chin cup, face-guard, cantilever pads, cantilever supports, front energy-absorbing liner, and rear energy-absorbing liner will substantially reduce or eliminate any injury from such knocks and hits, including pucks striking at neck level; and the second being during a head-first collision between the player and a wall such as hockey arena boards, in which the player is commonly face-down and approaches the wall with the axis of the cervical spine parallel to the ice or tilted front-down somewhat, so that the outermost portion of the extension strikes the wall with the tip being vertically higher than the axis of rotation of the helmet about the head, so that the momentum of the head and torso causes a reaction force against the cantilever pads and therethrough to the cantilevers and so to the casing, causing the helmet to begin to rotate in a direction that takes the tip vertically upwards, following which the rollers facilitate the movement of the helmet upwards along the surface of the wall; the head, neck, and a small portion of the torso move forward inside the helmet pushing the flexible cantilevers to the side; the flange settles against and symmetrically around the torso, stabilized against the stiffer portions of the casing under the tip and above the front of the head; and the full reaction force from the wall is transmitted through the helmet casing, including through its integral stiffening ridges, to the torso, thereby preventing axial load on, and injury in, the neck of the player.

2. A helmet for the prevention of collision-induced injuries, including severe neck injuries, comprising:

a casing having a top and formed to fit overtop a human head and to extend downward to a lower edge spaced above the top of a human torso;

an energy-absorbing vertically flexible liner inside and spaced from said top of said casing;

wherein, in use, the helmet is positioned on the head by said liner; and wherein, in use, the spacing between a lower surface of said top of said casing and said head is always greater than the spacing between said lower edge of said casing and said top of the torso such that under a large force exerted on said top of said helmet, the lower edge of said casing impacts on the top of said torso to thereby prevent contact of said top of said casing with said head.

3. A helmet as in claim 2, wherein said vertically flexible liner includes flexible cantilever supports for supporting said helmet on said head.

4. A helmet as in claim 2, wherein the casing is stiffer above the back of the head and above the front of the head than above the center of the head, whereby under the influence of a strong force produced when the top of the helmet contacts a plane surface the helmet stabilizes and presses symmetrically into the torso.

5. A helmet as in claim 4, in which the support means consists of flexible cantilever supports affixed to the inside of the casing, and in which when the head, neck, and a small portion of the torso move forward inside the helmet under said large force exerted on said top of said helmet the cantilever supports are pushed aside by said movement.

6. A helmet as in claim 2, in which the casing has a gap over the face of the player, and a face-guard and chin-cup affixed over this gap.

7. A helmet as in claim 2 wherein said lower edge of said casing includes a flange whereby to distribute said force onto the torso over a larger surface area.

8. A helmet for the prevention of collision-induced injuries, including severe neck injuries, comprising:

a casing having a top section and a bottom and formed to fit overtop a human head, the casing having an outwardly flaring flange at said bottom, an upwards extension at said top section with an edge at the rearwards extent of the extension, said extension having a top;

rollers on said top of said extension;

an energy-absorbing liner inside said casing;

means of supporting the casing on top of the head; and wherein, in use, the helmet is supported and positioned on the head by said support means and liner, and the spacing between a lower surface of said top of said casing and said head is always greater than the spacing between said lower edge of said casing and said top of the torso such that under a large force exerted on said top of said helmet, the lower edge of said casing impacts on the top of said torso to thereby prevent contact of said top of said casing with said head.

9. A helmet as in claim 8, in which the casing is formed so that the distance from the point of rotation of the casing about the head to the outer surface of the casing increases progressively and substantially from the front of the head to the said edge.

10. A helmet as in claim 8, in which the support means consists of flexible cantilever supports affixed to the inside of the casing.

11. A helmet as in claim 8, wherein the casing is stiffer above the back of the head and above the front of the head than above the center of the head, so that under the influence of a strong force produced when the top section of the helmet contacts a plane surface the helmet stabilizes rather than rolling, and presses symmetrically into the torso.

12. A helmet as in claim 8, wherein in use a portion of the casing over said back of the neck has an extension extending down past the neck to the top of the torso, so that backwards flexure of the neck will not press a bottom edge of the casing into the back of the neck.

* * * * *